US010654295B2

(12) United States Patent
Hamada

(10) Patent No.: US 10,654,295 B2
(45) Date of Patent: May 19, 2020

(54) MEDIUM SUPPORT UNITS, PRINTING APPARATUSES, AND METHODS FOR ATTACHING AND DETACHING FRICTION MEMBER

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 15/903,903

(22) Filed: Feb. 23, 2018

(65) Prior Publication Data

US 2018/0244080 A1 Aug. 30, 2018

(30) Foreign Application Priority Data

Feb. 24, 2017 (JP) ..... 2017-033571

(51) Int. Cl.
*B41J 11/06* (2006.01)
*B41J 3/407* (2006.01)

(52) U.S. Cl.
CPC ..... *B41J 11/06* (2013.01); *B41J 3/4078* (2013.01)

(58) Field of Classification Search
CPC . B41J 3/4078; B41J 11/06; B41J 11/13; B41J 13/24; B41J 29/13; B65H 2701/174
See application file for complete search history.

(56) References Cited

U.S. PATENT DOCUMENTS 4,819,559 A * 4/1989 Szarka ..... B41F 15/0863 101/126
5,090,313 A * 2/1992 Chapman ..... B41F 15/0863 101/115
7,311,041 B2 * 12/2007 Niimi ..... B41F 15/02 101/114
9,981,483 B2 * 5/2018 Hamada ..... B41J 3/4078
2003/0197750 A1 * 10/2003 Iwatsuki ..... B41J 3/28 347/19
2003/0197772 A1 * 10/2003 Iwatsuki ..... B41J 3/4078 347/104
2004/0189776 A1 9/2004 Niimi et al.
2005/0068358 A1 * 3/2005 Mizutani ..... B41J 2/2132 347/14
2005/0179708 A1 * 8/2005 Ben-Zur ..... B41J 3/28 347/2

(Continued)

FOREIGN PATENT DOCUMENTS

JP 2004-291430 A 10/2004
JP 2004291430 * 10/2004 ..... B41J 11/06

(Continued)

*Primary Examiner* — Matthew G Marini
*Assistant Examiner* — Marissa Ferguson-Samreth
(74) *Attorney, Agent, or Firm* — Workman Nydegger

(57) ABSTRACT

A medium support unit which supports a medium while printing is performed on the medium by a printing apparatus, the medium support unit including: a support member having a support surface that supports the medium; a frame which is detachably attached to the support member; and a friction member which has a static friction coefficient to the medium higher than that of the support surface, the friction member being attached to the frame so as to cover the support surface when the frame is attached to the support member.

13 Claims, 10 Drawing Sheets

(56) References Cited

U.S. PATENT DOCUMENTS

2006/0243852 A1* 11/2006 Valls Roca ..... B31F 1/0038 242/605
2013/0057632 A1* 3/2013 Moriya ..... B41J 3/4078 347/104
2013/0104762 A1* 5/2013 Yanagishita ..... B41J 3/4078 101/407.1
2014/0020189 A1* 1/2014 Weibel ..... D06B 1/02 8/499
2015/0151551 A1* 6/2015 Livingston ..... B41J 3/4078 347/110
2015/0273866 A1* 10/2015 Sakai ..... B41J 11/002 347/21
2016/0279988 A1* 9/2016 Kobayashi ..... B41J 2/04508
2017/0106673 A1* 4/2017 Fujimori ..... B41J 3/4078
2017/0320316 A1* 11/2017 Nakamura ..... B41J 11/06
2017/0320339 A1* 11/2017 Matsumoto ..... B41J 11/002
2018/0147858 A1* 5/2018 Kunioka ..... B41J 3/4078
2018/0154656 A1* 6/2018 Ueno ..... B41J 11/06
2018/0162148 A1* 6/2018 Komiya ..... B41J 11/06
2018/0170087 A1* 6/2018 Kobayashi ..... B41M 7/009
2018/0313033 A1* 11/2018 Yanase ..... B41F 15/12
2019/0009575 A1* 1/2019 Mombourquette .... B41J 3/4078

FOREIGN PATENT DOCUMENTS

JP 2004291461 * 10/2004
JP 2006123361 * 10/2004 ..... B41J 13/00
JP 2006240082 * 9/2006 ..... B41J 2/01
JP 2013096017 * 5/2013 ..... D06B 23/04
JP 2013245615 * 12/2013 ..... B41J 13/10
JP 2014200743 * 11/2017 ..... B41J 11/06

* cited by examiner

MEDIUM SUPPORT UNITS, PRINTING APPARATUSES, AND METHODS FOR ATTACHING AND DETACHING FRICTION MEMBER

BACKGROUND

1. Technical Field

The present invention relates to medium support units, printing apparatuses, and methods for attaching and detaching a friction member.

2. Related Art

Medium support units are conventionally used to support a medium by a support member. Among these, there are medium support units configured to hold a medium on a support member by using a friction member (prevent a medium from being displaced). For example, JP-A-2004-291430 discloses a fabric printing apparatus (printing apparatus which includes a medium support unit) configured to hold a fabric as a medium on a platen as a support member by using a cotton cloth as a friction member adhered to the center of the platen so that the medium is held by means of a friction force of the cotton cloth.

According to the medium support unit as disclosed in JP-A-2004-291430, which is configured to hold a medium on the support member by using the friction member, a medium can be reliably held on a support member by using a friction member. In some cases, however, it is desired to attach a friction member or detach a friction member depending on the types of the medium used. However, in the fabric printing apparatus disclosed in JP-A-2004-291430, a cotton cloth is attached by a double-sided adhesive tape, which involves cumbersome process such as alignment and wrinkle release of the cotton cloth in attachment of the friction member, and peeling of the cotton cloth in detachment of the friction member.

SUMMARY

An advantage of some aspects of the invention is to ensure that a friction member for holding a medium on a medium support unit can be attached and detached in a simple manner.

An aspect of the invention is a medium support unit which supports a medium while printing is performed on the medium by a printing apparatus, the medium support unit includes a support member having a support surface that supports the medium, a frame which is detachable from the support member, and a friction member which has a static friction coefficient to the medium higher than that of the support surface, the friction member being attached to the frame so as to cover the support surface when the frame is attached to the support member.

With this configuration, the friction member is attached to the frame which is detachably attached to the support member. Since the frame can be easily detachably attached (attached and detached) to the support member, the friction member can also be easily detachably attached to the support member. That is, the friction member can be easily detachably attached to the medium support unit. The "support surface that supports a medium" means not only a configuration by which a medium is directly supported by the support surface, but also a configuration by which a medium is indirectly supported by the support surface via other members disposed on the support surface (without being directly in contact with the medium).

In the above aspect of the invention, the medium support unit further includes a low swelling member that is disposed between the friction member and the support surface, and is less likely to swell than the friction member, wherein the friction member and the low swelling member are adhered to each other.

With this configuration, since the low swelling member adhered to the friction member is provided between the friction member and the support surface, the friction member can be prevented from being deformed due to swelling.

In the above aspect of the invention, the low swelling member is provided sandwiched between the friction member and the frame.

With this configuration, since the low swelling member is provided sandwiched between the friction member and the frame, the low swelling member can be reliably held by the friction member and the frame. Accordingly, the low swelling member can be particularly effectively prevented from being displaced relative to the friction member, and the low swelling member and the friction member can be particularly effectively prevented from being deformed.

In the above aspect of the invention, the low swelling member is provided inside the frame.

With this configuration, since the swelling member is provided inside the frame, a portion of the friction member which corresponds to the region where the low swelling member inside the frame is located is raised due to the thickness of the low swelling member when the frame is attached to the tray, and accordingly, an inclined surface is formed at a region around the raised area (the region which generally corresponds to the periphery of the support surface). For example, since the medium expands outward when the medium swells, the medium is likely to be lifted from the tray at the region around the support surface. However, such lifting can be prevented by virtue of the inclined surface formed corresponding to the periphery of the support surface. The phrase that the low swelling member is "provided inside the frame" means that the low swelling member is located only inside the frame, and not at a position between the friction member and the frame.

In the above aspect of the invention, an adhesive material is provided on a surface that faces the support surface when the frame is attached to the support member.

With this configuration, since the adhesive material is provided on a surface that faces the support surface when the frame is attached to the support member, the friction member can be prevented from being displaced (misaligned) relative to the support member, and allow the friction member to effectively extend along the support surface (for example, effectively increase the flatness of the friction member).

In the above aspect of the invention, an adhesive material is not provided on a surface that faces the support surface when the frame is attached to the support member.

With this configuration, since the adhesive material is not provided on a surface that faces the support surface when the frame is attached to the support member, the friction member can be particularly easily attached and detached.

In the above aspect of the invention, the friction member is attached to the frame so as to cover an outer peripheral surface of the frame.

With this configuration, since the friction member is attached to the frame so as to cover an outer peripheral surface of the frame, a medium can also be held on the outer peripheral surface of the frame by the friction member extending on the outer peripheral surface of the frame and can be particularly reliably held on the support member.

Another aspect of the invention is a printing apparatus including: the medium support unit according to the above aspect; and a print section that performs printing onto a medium supported by the medium support unit.

With this configuration, the printing apparatus can perform printing while a medium is reliably held on the support member by the friction member, and also can easily switch between a state where the friction member is attached and a state where the friction member is detached depending on the types of the medium used.

Another aspect of the invention is a method for attaching and detaching a friction member to and from a medium support unit which supports a medium while printing is performed on the medium by a printing apparatus, the medium support unit including: a support member having a support surface that supports the medium; a frame which is detachable from the support member; and the friction member which has a static friction coefficient to the medium higher than that of the support surface, the friction member being attached to the frame so as to cover the support surface when the frame is attached to the support member, wherein the friction member is attached and detached to and from the medium support unit by attaching and detaching the frame to and from the support member.

With this configuration, since the friction member is detachably attached to the frame that is detachably attached to the support member, and the frame can be easily detachably attached to the support member, the friction member can also be easily detachably attached to the support member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
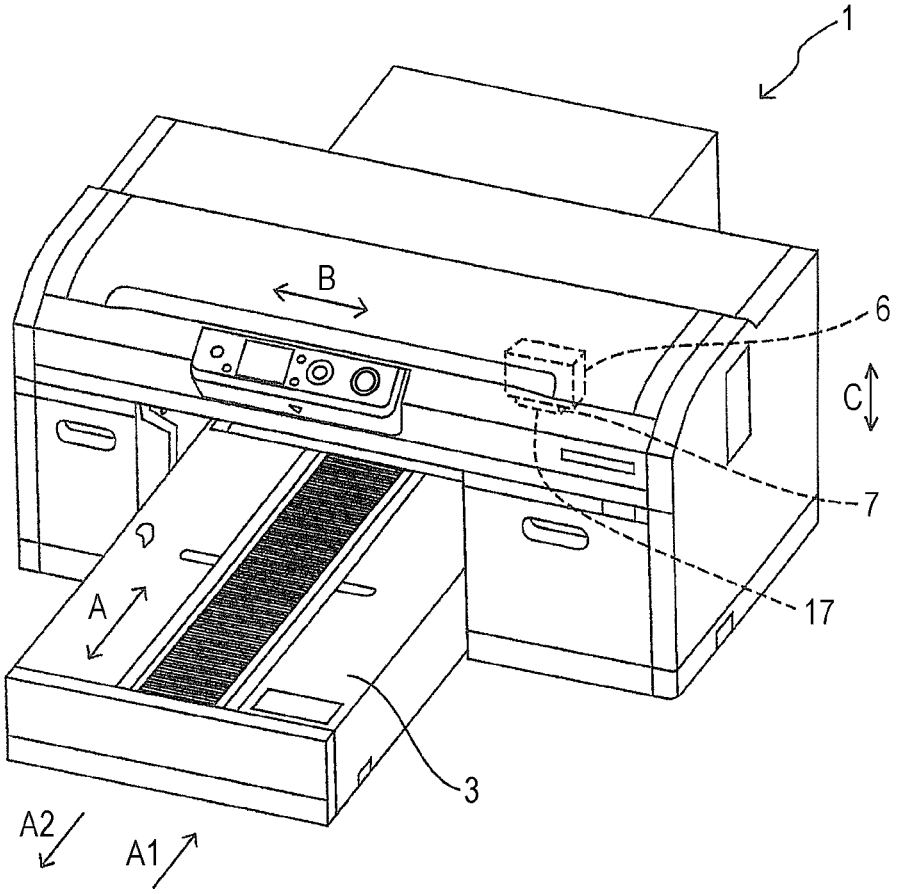
FIG. 1 is a schematic perspective view of a printing apparatus according to an example of the invention.
Figure 2:
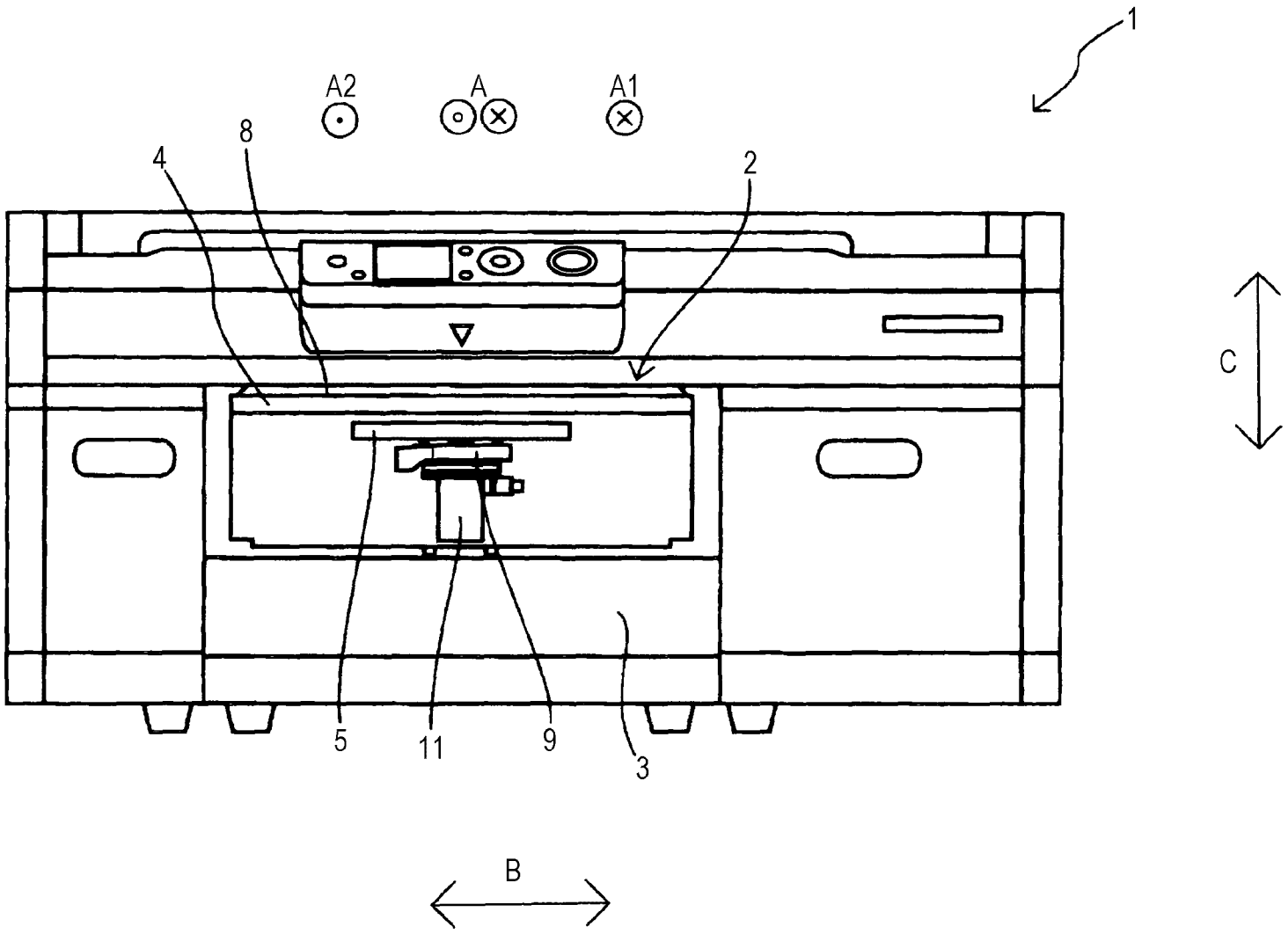
FIG. 2 is a schematic front view of a printing apparatus according to an example of the invention.
Figure 3:
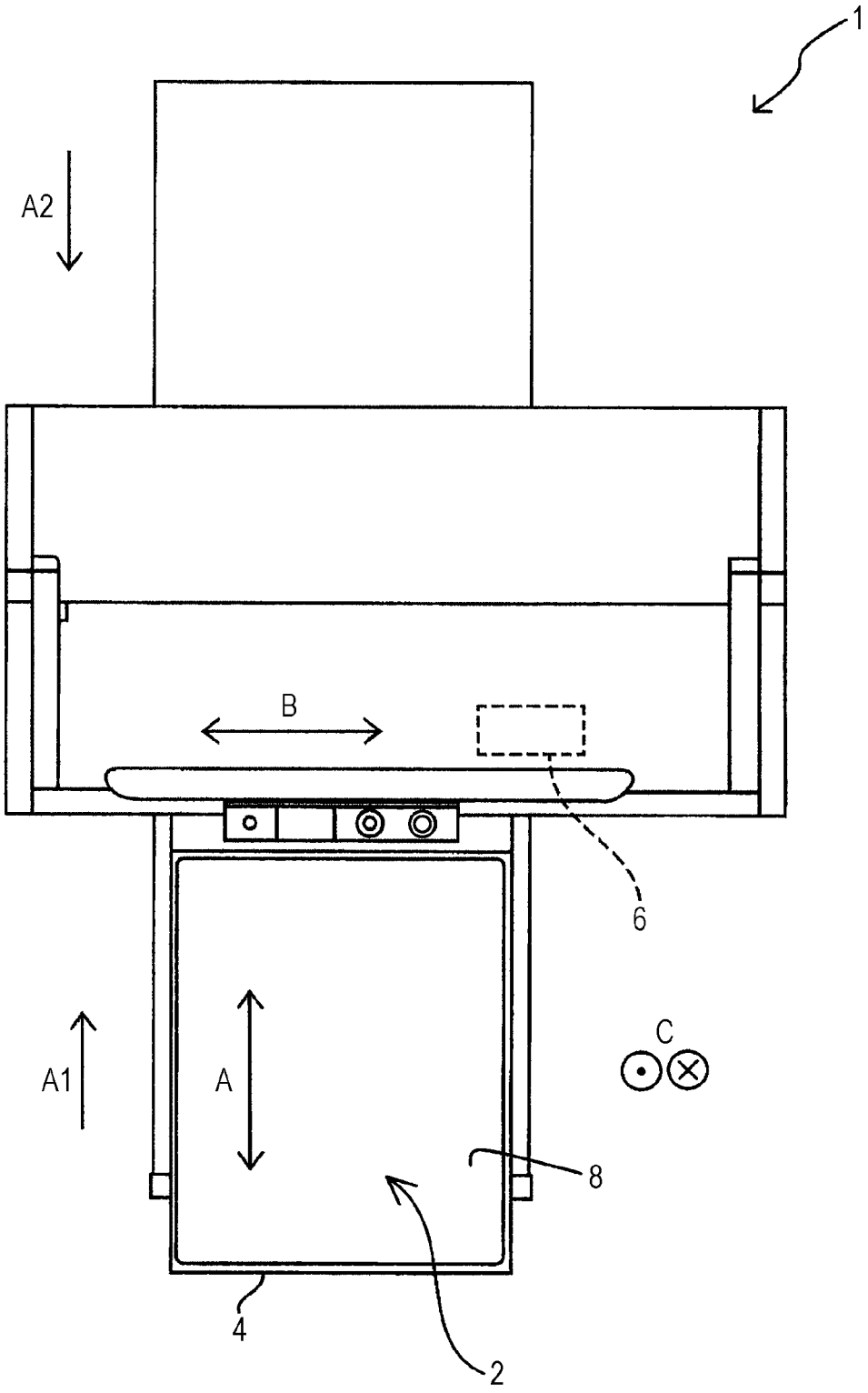
FIG. 3 is a schematic plan view of a printing apparatus according to an example of the invention.

With reference to the drawings, a printing apparatus 1 according to an example of the invention will be described in detail. FIG. 1 is a schematic perspective view of the printing apparatus 1 according to the present example, illustrating that a medium support unit 2 is at a print start position. Further, FIG. 2 is a schematic front view of the printing apparatus 1 of the present example. FIG. 3 is a schematic plan view of the printing apparatus 1 of the present example, illustrating that the medium support unit 2 is at a medium setting position. In FIGS. 1 to 3, some components are not shown for the convenience of illustration.

The printing apparatus 1 of the present example includes the medium support unit 2. The medium support unit 2 includes a tray 4 as a support member, and the tray 4 has a support surface 8 for supporting a medium. The medium support unit 2 moves in a movement direction A while supporting a medium by the support surface 8 of the tray 4. Further, the printing apparatus 1 includes a medium transportation unit 3 that transports a medium supported by the tray 4 in the movement direction A. The movement direction A includes a direction A1 and a direction A2 which is a direction opposite to the direction A1.

Further, the medium support unit 2 is detachably mounted on a stage 5. In the printing apparatus 1 of the present example, an attachment and detachment direction C of the medium support unit 2 with respect to the stage 5 is a vertical direction. The medium support unit 2 moves in a direction along the attachment and detachment direction C (vertical direction) together with the stage 5 by rotating a lever 9. As shown in FIG. 2, the lever 9 is provided on an arm 11. A variety of materials such as textile (woven fabric, cloth, and the like), paper, and vinyl chloride resin as a medium.

Further, the printing apparatus 1 includes a print head 7 as a print section in the main body. The print head 7 can perform printing on a medium by ejecting ink as an example of liquid via nozzles, which are not shown, formed on a forming surface 17. The printing apparatus 1 of the present example forms a desired image by ejecting ink from the print head 7 onto a medium supported by the tray 4 while reciprocating a carriage 6 as a holding section that holds the print head 7 in a scan direction B which is perpendicular to the movement direction A to thereby reciprocates the print head 7 in the scan direction B. In the printing apparatus 1 of the present example, the medium setting position on the tray 4 is on the front side (lower left position) in FIG. 1 (see FIG. 3). The tray 4 on which the medium is set is moved in the direction A1 of the movement direction A to the print start position on the back side of the FIG. 1 (upper right position). After that, printing is performed while the tray 4 is moved in the direction A2 of the movement direction A.

Figure 4:
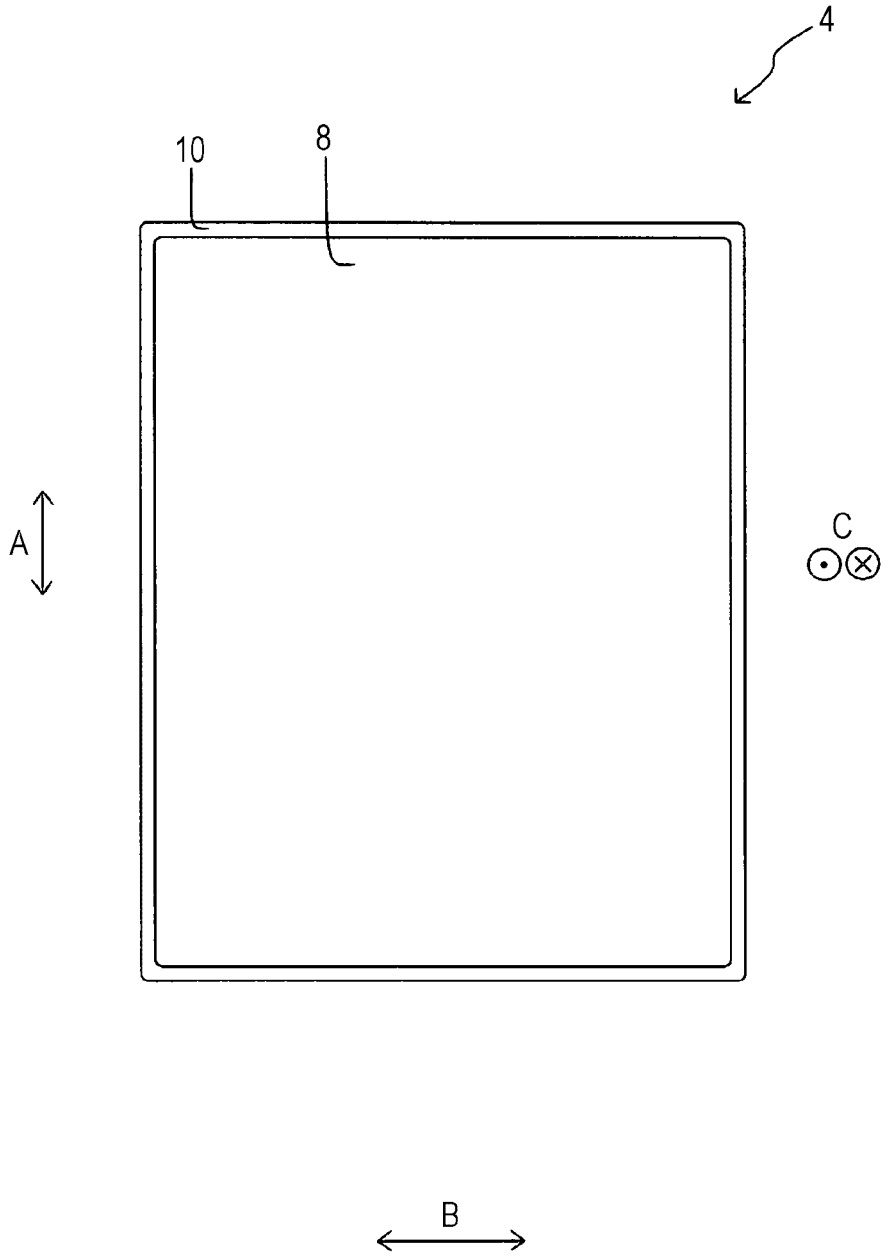
FIG. 4 is a schematic plan view of part of a medium support unit which can be used in a printing apparatus according to an example of the invention.
Figure 5:
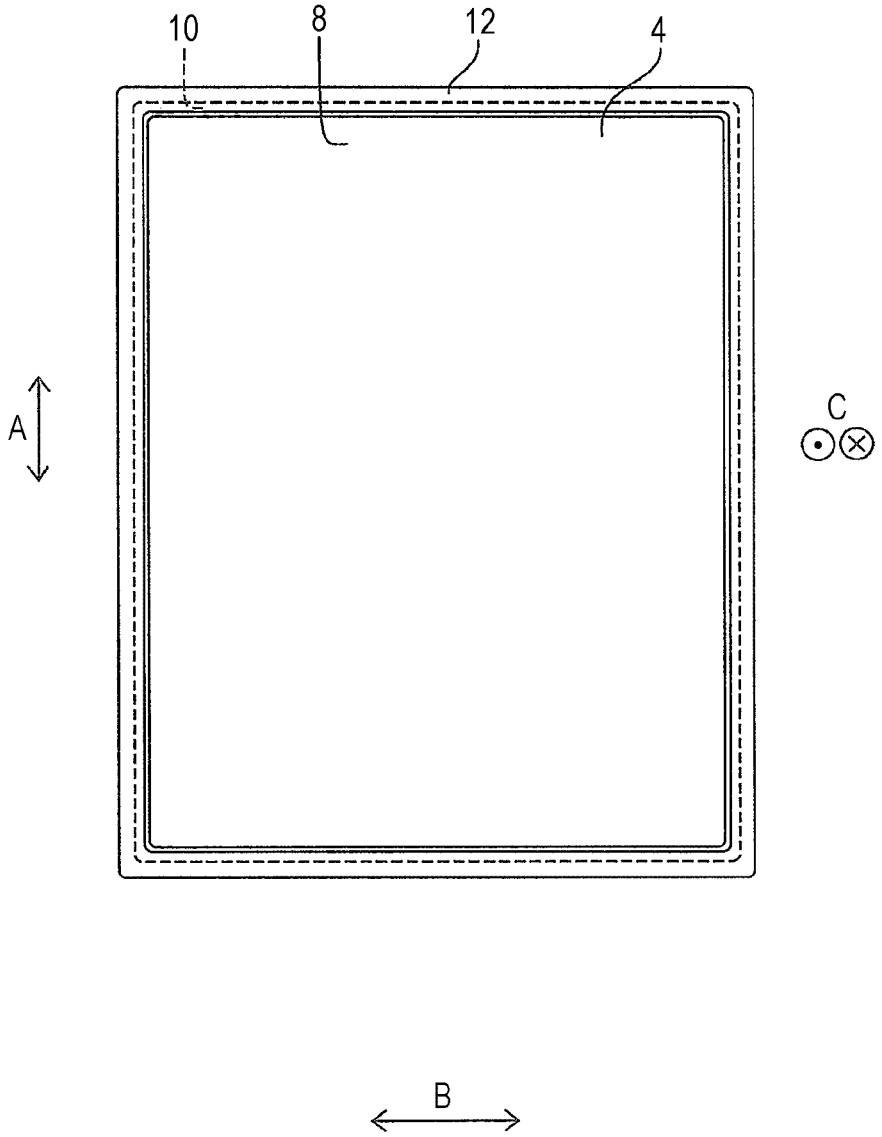
FIG. 5 is a schematic plan view of part of a medium support unit which can be used in a printing apparatus according to an example of the invention.
Figure 6:
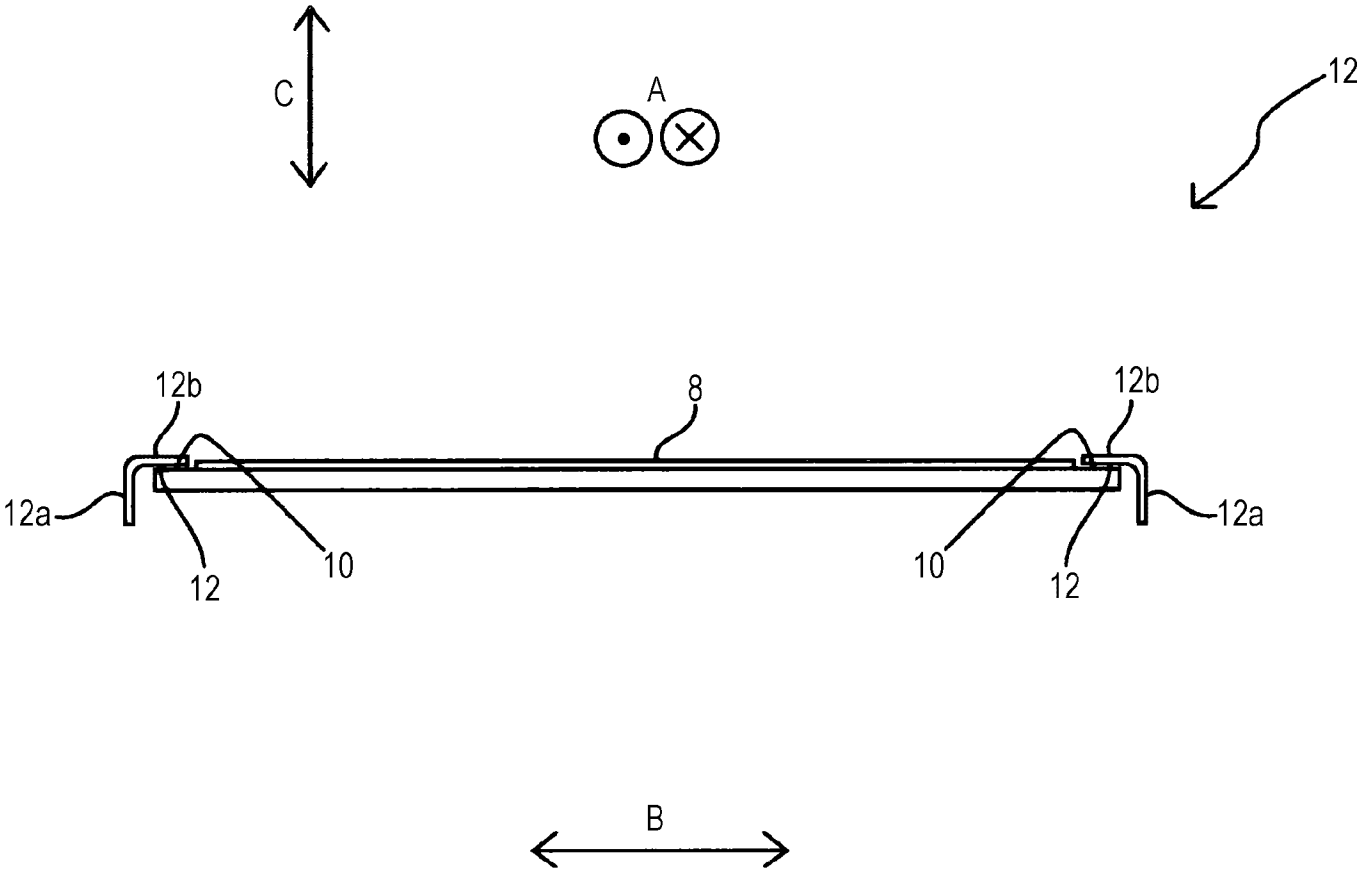
FIG. 6 is a schematic front cross-sectional view of part of a medium support unit which can be used in a printing apparatus according to an example of the invention.
Figure 7:
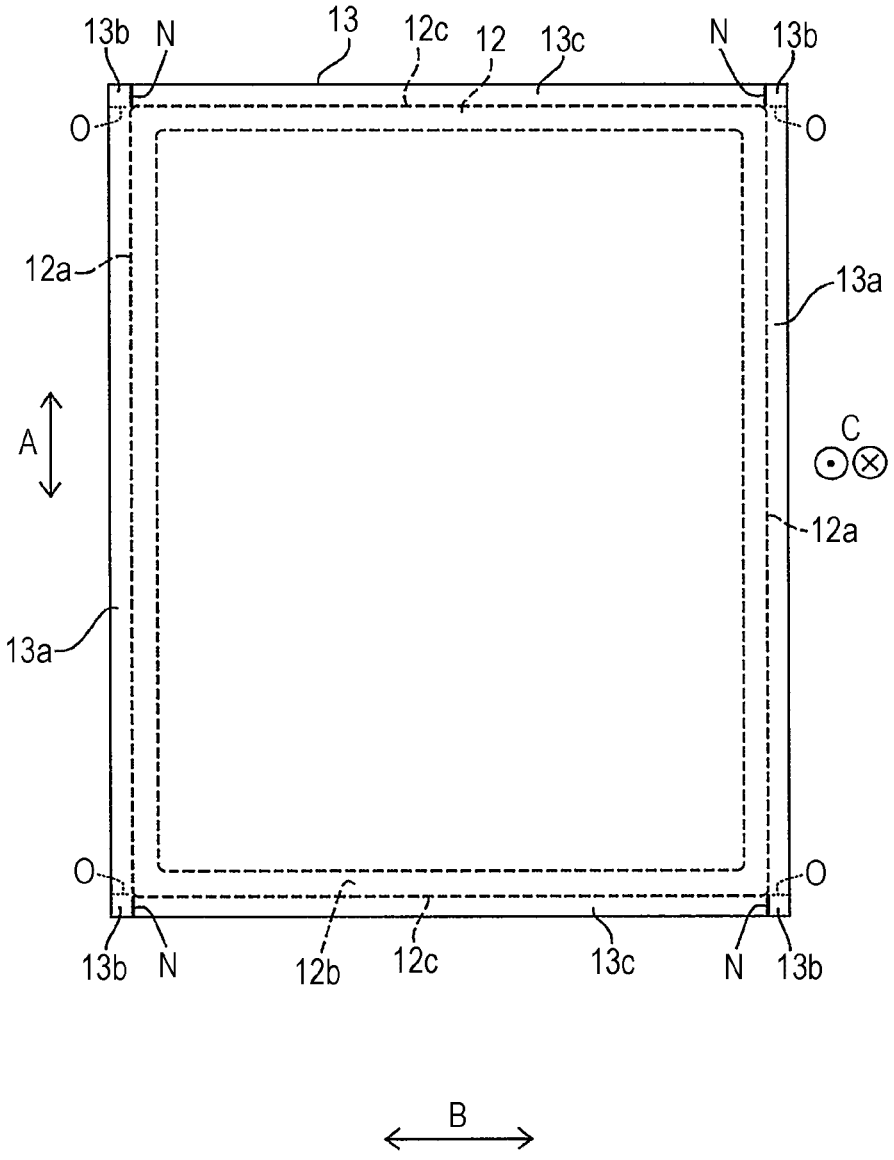
FIG. 7 is a schematic plan view of part of a medium support unit which can be used in a printing apparatus according to an example of the invention.
Figure 8:
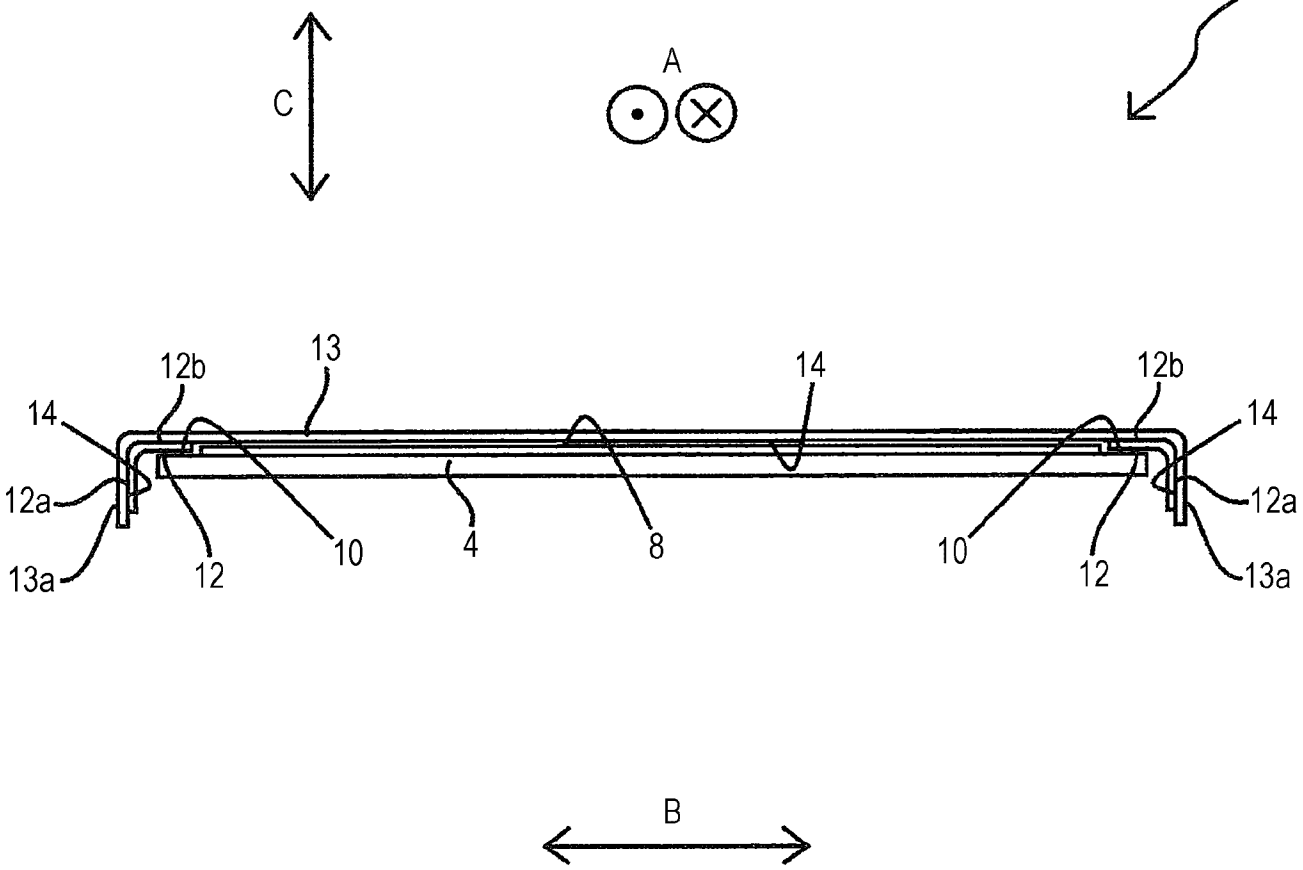
FIG. 8 is a schematic front cross-sectional view of part of a medium support unit which can be used in a printing apparatus according to an example of the invention.

Next, the medium support unit 2, which is an essential part of the printing apparatus 1 of the present example will be described. FIG. 4 is a schematic plan view of the tray 4, which is one of components that constitute the medium support unit 2. FIG. 5 is a schematic plan view of the tray 4 and a frame 12 which is detachably attached (can be detached and attached) to the tray 4, illustrating that the frame 12 is attached to the tray 4. FIG. 6 is a schematic front cross-sectional view of the tray 4 and the frame 12, illustrating that the frame 12 is attached to the tray 4. FIG. 7 is a schematic plan view of the frame 12 and the friction member 13, illustrating the positioning when the friction member 13 is attached to the frame 12. FIG. 8 is a schematic front cross-sectional view of the tray 4, the frame 12, and the friction member 13 as the medium support unit 2, illustrating that the frame 12 is attached to the tray 4 with the friction member 13 being attached to the frame 12.

As shown in FIG. 4, the tray 4 of the present example has a substantially rectangular shape in plan view, and a frame receiver 10 is disposed so as to form a level difference (see FIG. 8) to the support surface 8 at a position lower than the support surface 8. With this configuration, the tray 4 of the present example is capable of pressing the medium (holding the medium) set on the support surface 8 against the support surface 8 by placing the frame 12 on the support surface 8 (on the frame receiver 10). When the medium is not slippery on the support surface 8, the printing apparatus 1 of the present example can advantageously print an image on the medium by sandwiching the medium between the tray 4 (frame receiver 10) and the frame 12. Further, FIGS. 5 and 6 illustrate the positioning of the tray 4 and the frame 12 when the medium is sandwiched therebetween.

Furthermore, the printing apparatus 1 of the present example is configured to support a medium by a configuration in which a friction member 13 (a member having a static friction coefficient to the medium lower than that of the support surface 8) is attached to the frame 12, which in turn placed on the tray 4 (frame receiver 10) with the friction member 13 being attached to the frame 12, and a medium is placed thereon (on the friction member 13). Accordingly, when a medium is slippery on the support surface 8, the printing apparatus 1 of the present example can advantageously print an image on the medium by providing the friction member 13 on the tray 4. The friction member 13 may be, for example, a cloth. When the support surface 8 is made of a resin member, a cloth having a static friction coefficient to the medium higher than that of the resin member can be used as the friction member 13. However, a member used as the friction member 13 is not necessarily a cloth, and any material having a static friction coefficient to the medium higher than that of the support surface 8 may be used. The medium can be prevented from being displaced on the support surface 8 by placing the friction member 13 on the tray 4. Displacement of a medium on the support surface 8 includes a case where the medium generally moves in one direction relative to the support surface 8, and a case where the medium is swelled and displaced (expands) in all directions relative to the support surface 8, for example, in the first printing stage of the medium when two-stage printing is performed to the medium. For example, in the first printing stage when two-stage printing is performed to the medium (for example, base printing using white ink), if the medium is swelled and displaced (expands) in all directions relative to the support surface 8, there is a risk of misalignment of the image in the next printing stage (for example, the base print by white ink may be present outside the image of the next printing stage).

As shown in FIG. 7, the friction member 13 that can be used in the printing apparatus 1 (medium support unit 2) of the present example is formed in a substantially rectangular shape and has notches N that correspond to the respective corners of the tray 4. In the present example, since the corners of the friction member 13 and the corners of the tray 4 have positional relationship which correspond to each other, the notches N are formed at each of the corners of the friction member 13. As shown in FIG. 7, the friction member 13 is disposed on the frame 12, and each end 13*a* of the friction member 13 is adhered to each side surface 12*a* of the frame 12 which extends along the movement direction A, then each of four corners 13*b* of the friction member 13 is folded into a mountain fold at each crease O and adhered to each side surface 12*c* of the frame 12 which extends along the scan direction B, and each end 13*c* of the friction member 13 is adhered to each side surface 12*c*.

FIG. 8 shows that the friction member 13 is attached (adhered) to the frame 12, which in turn attached to the tray 4 with the friction member 13 being attached to the frame 12 so that the friction member 13 covers the support surface 8. Further, an adhesive material 14 is disposed across the entire surface of the friction member 13 of the present example which is opposite to the surface that supports the medium, that is, the surface to be attached (adhered) to the frame 12. As a result, the friction member 13 is configured to be adhered to the side surfaces 12*a* and 12*c* of the frame 12 and to the top 12*b* of the frame 12 via the adhesive material 14. Further, the friction member 13 is configured to be adhered to the support surface 8 of the tray 4 as well. With this configuration, the medium support unit 2 of the present example allows the friction member 13 to be reliably fixed to the tray 4 (support surface 8) as well as the frame 12. In addition to that, the friction member 13 can be positioned along (conforming to) the support surface 8 having high flatness, which enables to increase the flatness of the surface of the friction member 13 which supports the medium. The friction member 13 can be easily detached from the support surface 8 by detaching the frame 12 on which the friction member 13 is attached from the tray 4. Although the adhesive material 14 of the present example is a double-sided tape, it is not limited thereto. For example, an adhesive such as glue can also be used.

Here, a brief summary of the medium support unit 2 of the present example will be described. The medium support unit 2 of the present example serves to support a medium while the printing apparatus 1 performs printing on the medium, and includes the tray 4 having the support surface 8 that supports a medium, a frame 12 which is detachably attached to the tray 4, and a friction member 13, which has a static friction coefficient to the medium higher than that of the support surface 8, attached to the frame 12 so as to cover the support surface 8 when the frame 12 is attached to the tray 4. According to this configuration of the medium support unit 2 of the present example, the frame 12 is easily detachably attached (can be attached and detached) to the tray 4. Accordingly, the friction member 13 is also easily detachably attached to the tray 4. That is, the medium support unit 2 of the present example has a configuration by which the friction member 13 is easily detachably attached. The "support surface 8 that supports a medium" means not only a configuration by which a medium is directly supported by the support surface 8, but also a configuration by which a medium is indirectly supported by the support surface 8 via other members disposed on the support surface 8 (without being directly in contact with the medium). The support surface 8 of the present example indirectly supports the medium at least via the friction member 13.

The above can also be described from another viewpoint as a method for attaching and detaching the friction member 13 to and from the medium support unit 2 which serves to support a medium while the printing apparatus 1 performs printing on the medium, and includes the tray 4 having the support surface 8 that supports a medium, a frame 12 which is detachably attached to the tray 4, and a friction member 13, which has a static friction coefficient to the medium higher than that of the support surface 8, attached to the frame 12 so as to cover the support surface 8 when the frame 12 is attached to the tray 4. The method for attaching and detaching the friction member 13 is a method for attaching and detaching the friction member 13 to and from the medium support unit 2 by attaching and detaching the frame 12 to the tray 4. By performing such a method for attaching and detaching the friction member 13, the friction member 13 can be easily attached and detached to the tray 4.

Further, the above can also be described from still another viewpoint as the printing apparatus 1 according to the present example including the medium support unit 2, and the print head 7 as the print section that performs printing on a medium supported by the medium support unit 2. Accordingly, the printing apparatus 1 of the present example can perform printing while a medium is reliably held on the tray 4 by the friction member 13, and also can easily switch between a state where the friction member 13 is attached and a state where the friction member 13 is detached depending on the types of the medium used. For example, in the state where the friction member 13 is detached, an adjustment pattern or the like of the print head 7 can be printed on the support surface 8, and is then wiped off after the adjustment process of the print head 7. Then, in the state where the friction member 13 is attached, printing can be performed on a desired medium. That is, ink ejection accompanying the adjustment process or the like of the print head 7 can be performed not onto the friction member 13, but onto the tray 4 (onto the support surface 8). This is because the tray 4 is commonly made of a material that is not likely to absorb water (such as a resin member) in general, and ink can be easily wiped off.

Further, as described above, the adhesive material 14 is disposed on the surface of the medium support unit 2 of the present example frame 12 which faces the support surface 8 when the frame 12 is attached to the tray 4 (see FIG. 8). Accordingly, the medium support unit 2 of the present example can prevent the friction member 13 from being displaced (misaligned) relative to the tray 4, and allow the friction member 13 to effectively extend along the support surface 8 (for example, effectively increase the flatness of the friction member 13).

However, the adhesive material 14 may not necessarily be disposed on the surface which faces the support surface 8 when the frame 12 is attached to the tray 4. With this configuration, the friction member 13 is not adhered to the support surface 8 since the adhesive material 14 is not disposed on the surface which faces the support surface 8 when the frame 12 is attached to the tray 4, and the friction member 13 can be particularly easily attached and detached.

Further, as seen from FIGS. 7 and 8, in the medium support unit 2 of the present example, the friction member 13 is attached to the frame 12 so as to cover the outer peripheral surface of the frame 12 (side surfaces 12*a* and 12*c* of the frame 12). Accordingly, the medium support unit 2 of the present example is configured to hold a medium on the outer peripheral surface of the frame 12 by the friction member 13 formed on the outer peripheral surface of the frame 12, and thus particularly reliably hold a medium on the tray 4.

Depending on the materials or the like of the friction member 13, the friction member 13 may swell due to moisture absorption. Accordingly, the printing apparatus 1 of the present example may use the medium support unit 2 provided with a low swelling member 15 that can reduce swelling of the friction member 13. A specific example of the medium support unit 2 provided with the low swelling member 15 that can be used in the printing apparatus 1 of the present example will be described.

Figure 9:
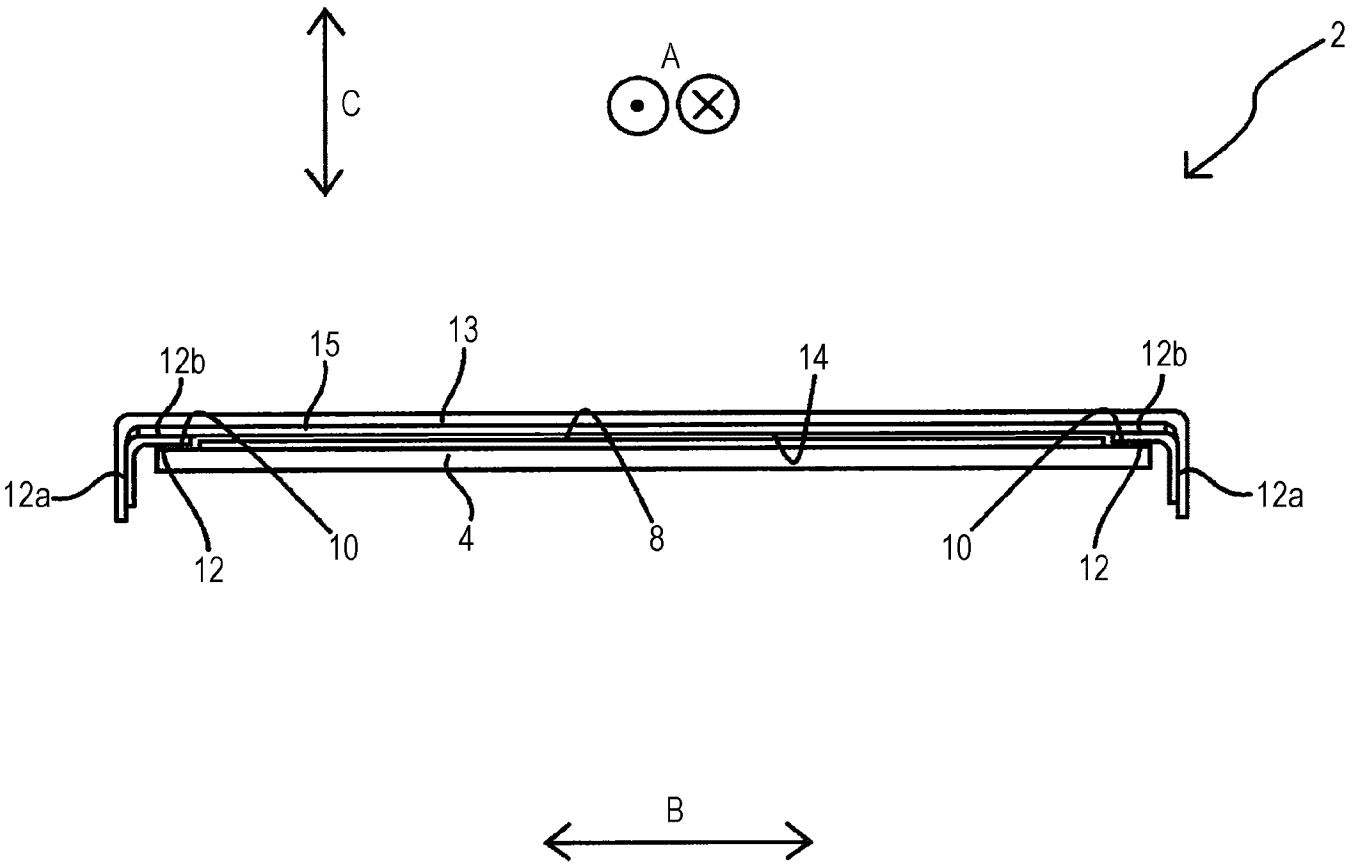
FIG. 9 is a schematic front cross-sectional view of part of a medium support unit which can be used in a printing apparatus according to an example of the invention.

FIG. 9 is a schematic front cross-sectional view of the tray 4, the frame 12, and the friction member 13 as the medium support unit 2, corresponding to FIG. 8 and illustrating that the low swelling member 15 is further provided in the configuration of FIG. 8. Further, FIG. 10 is a schematic front cross-sectional view of the tray 4, the frame 12, and the friction member 13 as the medium support unit 2, corresponding to FIGS. 8 and 9, and illustrating that the low swelling member 15 is provided in the configuration different from that shown in FIG. 9.

Figure 10:
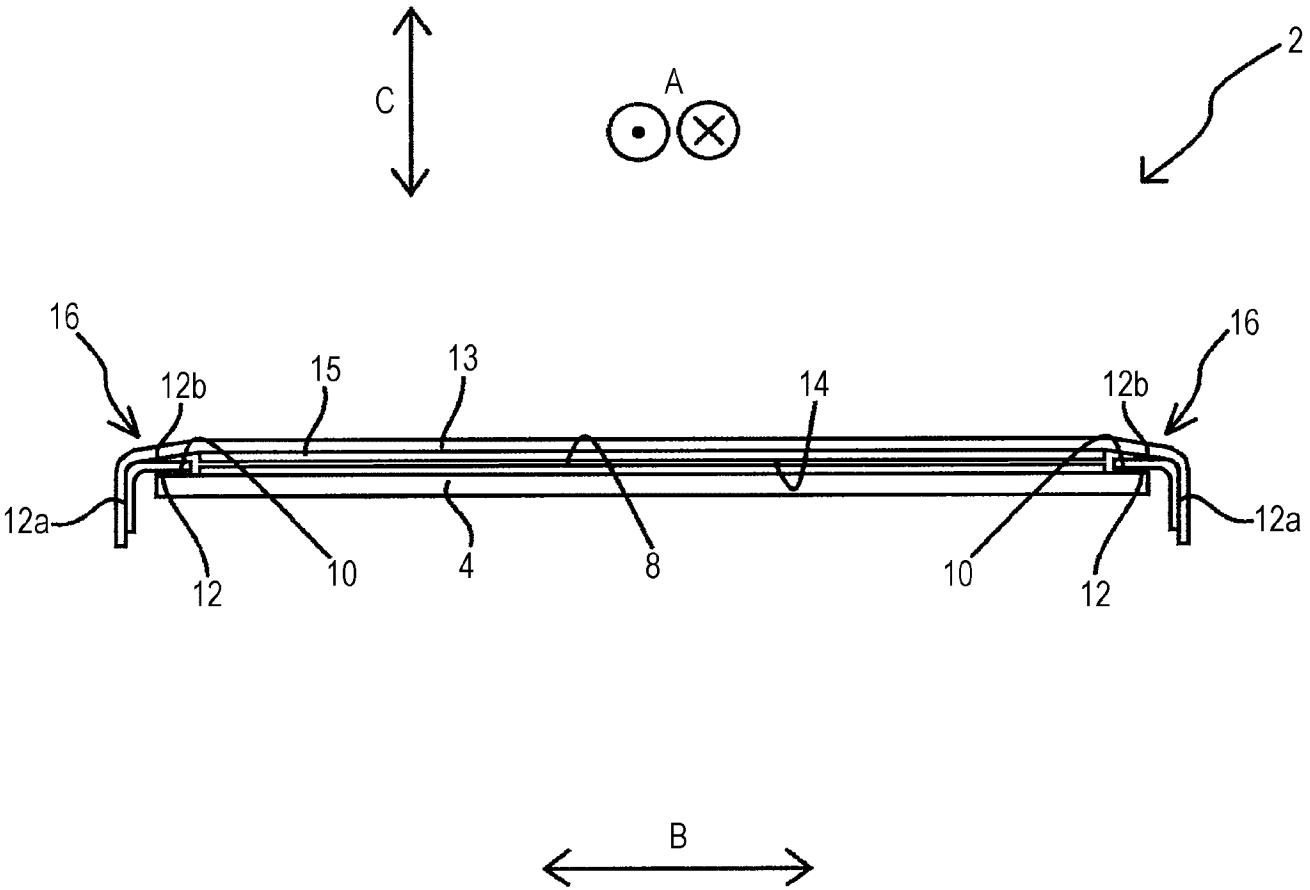
FIG. 10 is a schematic front cross-sectional view of part of a medium support unit which can be used in a printing apparatus according to an example of the invention.

The medium support unit 2 shown in FIGS. 9 and 10 is each provided with the low swelling member 15 that is disposed at a position between the friction member 13 and the support surface 8, and is less likely to swell than the friction member 13. The friction member 13 and the low swelling member 15 are adhered to each other. With this configuration, the medium support unit 2 shown in FIGS. 9 and 10 can each prevent the friction member 13 from being deformed due to swelling. The term "low swelling member" refers to a member that is less likely to swell than the friction member 13, and includes a non-swelling member that substantially does not swell. Specifically, for example, a plastic film which is a non-absorbable member, a metal plate such as aluminum, a resin sheet such as silicone, a sheet and a plate made of paper or wood may be used. When a cloth is used as the friction member 13, any member that is less likely to swell than the cloth can be used. Further, in the medium support unit 2 shown in FIGS. 9 and 10, the adhesive material 14 is provided across the entire surface of the underside (the surface which is in contact with the support surface 8) of the low swelling member 15. Accordingly, the medium support unit 2 can prevent the friction member 13 from being displaced (misaligned) relative to the tray 4, and allow the friction member 13 to effectively extend along the support surface 8 via the low swelling member 15 (for example, effectively increase the flatness of the friction member 13).

In the medium support unit 2 shown in FIG. 9, the low swelling member 15 is disposed not only on the top of the support surface 8, but also at a position between the frame 12 (top 12*b*) and the portion of the friction member 13 which corresponds to the top 12*b* of the frame 12. In other words, the low swelling member 15 is disposed between the friction member 13 and the frame 12. With this configuration, the medium support unit 2 shown in FIG. 9 can particularly effectively prevent the low swelling member 15 from being displaced relative to the friction member 13 to thereby particularly effectively prevent the low swelling member 15 and the friction member 13 from being deformed.

On the other hand, in the medium support unit 2 shown in FIG. 10, the low swelling member 15 is provided only on the support surface 8, that is, inside the frame 12. The term "inside the frame 12" refers to a region inside the frame 12 in plan view like FIG. 5. With this configuration, in the medium support unit 2 shown in FIG. 10, a portion of the friction member 13 which corresponds to the region where the low swelling member 15 inside the frame 12 is located is raised due to the thickness of the low swelling member 15 when the frame 12 is attached to the tray 4, and accordingly, an inclined surface 16 is formed at a region around the raised area (the region which generally corresponds to the periphery of the support surface 8). Since the medium expands outward when the medium swells by ink applied, for example, the medium is likely to be lifted from the tray 4 at the region around the support surface 8. However, in the medium support unit 2 shown in FIG. 10, such lifting can be prevented by virtue of the inclined surface 16 formed corresponding to the periphery of the support surface 8. By preventing the lifting, contact between the medium (the lifted portion) and the print head 7 in printing can be prevented. The phrase that the low swelling member 15 is "provided inside the frame 12" means that the low swelling member 15 is located only inside the frame 12, and not at a position between the friction member 13 and the frame 12 (the portion corresponds to the top 12*b* of the frame 12).

It should be noted that the present invention is not limited to the above embodiments. Needless to say, various modifications are contemplated within the scope of the invention as defined in the appended claims, and these should be included in the scope of the present invention. For example, although the friction member 13 in the aforementioned medium support unit 2 is detachably attached to the frame 12, the frame 12 on which the friction member 13 is attached and the frame 12 on which no friction member 13 is attached may be separately provided. In the configuration which can use the frame 12 on which no friction member 13 is attached, methods can be selected depending on the types of the medium between pressing a medium directly supported by the support surface 8 by using the frame 12 and placing a medium on the support surface 8 on which the friction member 13 is formed.

This application claims priority under 35 U.S.C. § 119 to Japanese Patent Application No. 2017-033571, filed Feb. 24, 2017. The entire disclosure of Japanese Patent Application No. 2017-033571 is hereby incorporated herein by reference.

What is claimed is:

1. A medium support unit which supports a medium while printing is performed on the medium by a printing apparatus, the medium support unit comprising:

a support member having a support surface that supports the medium;

a frame which is detachably attached to the support member; and a friction member which has a static friction coefficient to the medium higher than that of the support surface, the friction member being attached to the frame so as to cover the support surface when the frame is attached to the support member; and a low swelling member that is disposed between the friction member and the support surface, and is less likely to swell than the friction member, wherein the friction member and the low swelling member are adhered to each other.

2. The medium support unit according to claim 1, wherein the low swelling member is provided sandwiched between the friction member and the frame.

3. A printing apparatus comprising:

the medium support unit according to claim 2; and a print section that performs printing onto a medium supported by the medium support unit.

4. The medium support unit according to claim 1, wherein the low swelling member is provided inside the frame.

5. A printing apparatus comprising:

the medium support unit according to claim 4; and a print section that performs printing onto a medium supported by the medium support unit.

6. The medium support unit according to claim 1, wherein an adhesive material is provided on a surface that faces the support surface when the frame is attached to the support member.

7. A printing apparatus comprising:

the medium support unit according to claim 6; and a print section that performs printing onto a medium supported by the medium support unit.

8. The medium support unit according to claim 1, wherein an adhesive material is not provided on a surface that faces the support surface when the frame is attached to the support member.

9. A printing apparatus comprising:

the medium support unit according to claim 8; and a print section that performs printing onto a medium supported by the medium support unit.

10. The medium support unit according to claim 1, wherein the friction member is attached to the frame so as to cover an outer peripheral surface of the frame.

11. A printing apparatus comprising:

the medium support unit according to claim 10; and a print section that performs printing onto a medium supported by the medium support unit.

12. A printing apparatus comprising:

the medium support unit according to claim 1; and a print section that performs printing onto a medium supported by the medium support unit.

13. A method for attaching and detaching a friction member to and from a medium support unit which supports a medium while printing is performed on the medium by a printing apparatus, the medium support unit including:

a support member having a support surface that supports the medium;

a frame which is detachably attached to the support member;

the friction member which has a static friction coefficient to the medium higher than that of the support surface, the friction member being attached to the frame so as to cover the support surface when the frame is attached to the support member, wherein the friction member is attached and detached to and from the medium support unit by attaching and detaching the frame to and from the support member; and a low swelling member that is disposed between the friction member and the support surface, and is less likely to swell than the friction member, wherein the friction member and the low swelling member are adhered to each other.

* * * * *